US005279919A

United States Patent [19]

Okamura et al.

[11] Patent Number: 5,279,919

[45] Date of Patent: Jan. 18, 1994

[54] SILVER HALIDE PHOTOGRAPHIC MATERIAL

[75] Inventors: Hisashi Okamura; Kazumi Nii; Kazunobu Katoh, all of Kanagawa, Japan

[73] Assignee: Fuji Photo Film Co., Ltd., Kanagawa, Japan

[21] Appl. No.: 920,641

[22] Filed: Jul. 28, 1992

[30] Foreign Application Priority Data

Jul. 30, 1991 [JP] Japan ..... 3-211356
Aug. 1, 1991 [JP] Japan ..... 3-214171

[51] Int. Cl.[5] ..... G03C 1/06
[52] U.S. Cl. ..... 430/264; 430/598
[58] Field of Search ..... 430/264, 598

[56] References Cited

U.S. PATENT DOCUMENTS 4,971,890 11/1990 Okada et al. ..... 430/264
4,988,604 1/1991 Machonkin et al. ..... 430/264
4,994,365 2/1991 Looker et al. ..... 430/598
5,028,510 7/1991 Okamura et al. .
5,041,355 8/1991 Machonkin et al. ..... 430/264
5,126,227 5/1992 Machonkin et al. ..... 430/264
5,130,480 7/1992 Ruger ..... 430/598

*Primary Examiner*—Richard L. Schilling
*Assistant Examiner*—Thomas R. Neville
*Attorney, Agent, or Firm*—Sughrue, Mion, Zinn, Macpeak & Seas

[57] ABSTRACT

A silver halide photographic material which comprises a compound represented by the following general formulae (Ia) or (Ib):

$$R^1—L^1—R^2—L^2—R^3—NHNH—G^1—R^4 \quad (Ia)$$

$$R^6—L^3—R^2—NHNH—G^1—R^4 \quad (Ib)$$

wherein the terms are as defined in the specification. The photographic material is capable of producing ultrahigh contrast images and is useful in photomechanical processes. An advantage of the material in comparison to prior materials is that can be developed using a developer having a lower pH value.

13 Claims, No Drawings

SILVER HALIDE PHOTOGRAPHIC MATERIAL

FIELD OF THE INVENTION

The present invention relates to a silver halide photographic material and a process for the formation of an ultrahigh contrast negative image using the silver halide photographic material. More particularly, the present invention relates to a silver halide photographic material suitable for use in photomechanical processes.

BACKGROUND OF THE INVENTION

In the field of graphic arts, in order to optimize the reproduction of continuous tone images or line images from a halftone image, image formation systems which exhibit ultrahigh contrast (particularly gamma of 10 or more) are required.

A known process for the formation of high contrast images comprises the use of a hydrazine derivative as disclosed in U.S. Pat. Nos. 4,224,401, 4,168,977, 4,166,742, 4,311,781, 4,272,606, and 4,211,857. In accordance with this process, ultrahigh contrast and a high sensitivity can be obtained and the addition of high concentration sulfite to the developer is allowed. Thus, the stability of the developer to air oxidation is drastically improved as compared with the lithographic developer.

However, the hydrazine compounds used in this type process have been found to have some disadvantages. That is, in order to eliminate the adverse effects of hydrazine compounds on other photographic light-sensitive materials when flowing into the developer, attempts were made to render the structure of these hydrazine compounds nondiffusive. These nondiffusive hydrazine compounds are disadvantageous in that they must be used in large amounts to provide sensitization and high contrast. When used in such large amounts, they tend to deteriorate the physical strength of the light-sensitive layers thus obtained or they tend to deposit in the coating solution. Furthermore, when a light-sensitive material comprising such a nondiffusible hydrazine compound is processed with a developer fatigued by the processing of a large amount of light-sensitive materials, it cannot provide a sufficiently high contrast.

Further, since ultrahigh contrast systems employing a hydrazine compound have heretofore required a developer having a relatively high pH value, on the order of 11.5 to 11.8, these systems are dangerous to handle and they have a high BOD or COD in waste disposal. Moreover, since large amounts of a pH buffer must be used to keep the pH value of the developer constant, the solids content of the developer is increased, making the developer sticky and difficult to wipe after it is scattered on the photographic material.

Thus, it has been desired to provide a hydrazine compound which can provide a high contrast in the presence of a developer with a lower pH value.

Moreover, light-sensitive materials for contact work commonly used in daylight may be used to make a wide variety of plate-making light-sensitive materials. In this field, a high letter image quality enabling the reproduction of fine Ming type letters has been desired. To this end, it has been desired to develop a nucleating agent having a higher activity. In particular, the nucleating agents currently in use in daylight light-sensitive materials which can be handled in daylight do not provide sufficiently higher contrast and thus a nucleating agent having an even higher activity is desired.

SUMMARY OF THE INVENTION

It is therefore an object of the present invention to provide a silver halide plate-making photographic material which exhibits an excellent rapid-processability and a high processing stability.

It is another object of the present invention to provide a silver halide plate-making photographic material which can be developed in a lower pH range.

It is further object of the present invention to provide a nucleating agent having a higher activity.

These and other objects of the present invention will become more apparent from the following detailed description and examples.

The objects of the present invention are accomplished using a silver halide photographic material comprising a compound represented by the following general formula (Ia) or (Ib):

$$R^1—L^1—R^2—L^3—R^3—NHNH—G^1—R^4 \quad \text{(Ia)}$$

$$R^6—L^3—R^2—NHNH—G^1—R^4 \quad \text{(Ib)}$$

wherein $L^1$ represents an $—SO_2NR^5—$ group, an $—NR^5SO_2NR^5—$ group, an $—NR^5CONR^5—$ group or a $—G^2P(O)(G^2R^5)—NR^5—$ group; $L^2$ represents an $—SO_2NR^5—$ group; $L^3$ represents an $—SO_2NR^5—$ group, an $—NR^5SO_2NR^5—$ group, a $—CONR^5—$ group, an $—NR^5CONR^5—$ group or a $—G^2P(O)(G^2R^5)—NR^5—$ group; $G^1$ represents a —CO— group, an $—SO_2—$ group, an —SO— group, a —COCO— group, a thiocarbonyl group, an iminomethylene group or a $—P(O)(G^2R^5)—$ group; $G^2$ represents a single bond, an —O— group or an $—NR^5—$ group; $R^1$ represents an aliphatic or aromatic group containing four or more repeating ethylene oxide units or an aliphatic or aromatic group containing at least one quaternary ammonium cation; $R^2$ and $R^3$ each represents a divalent aliphatic or aromatic group; $R^4$ represents a hydrogen atom, an aliphatic group, an aromatic group, an alkoxy group, an aryloxy group or an amino group; $R^5$ represents a hydrogen atom, an aliphatic group or an aromatic group; and $R^6$ is a group represented by formula (IIb), (IIIb), (IVb) or (Vb):

$$R^{11}—O—(CH_2CH_2O)_m—(CH_2)_p—(S—(CH_2)_r)_n— \quad \text{(IIb)}$$

(IIIb)

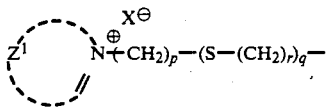

(IVb)

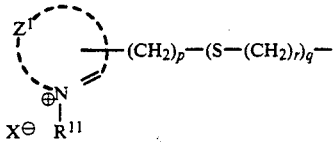

(Vb)

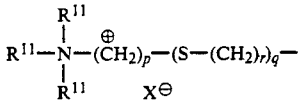

wherein $R^{11}$ represents an aliphatic or aromatic group; and the three $R^{11}$'s in general formula (Vb) may be the same or different and they may be connected to each other to form a ring;

$Z^1$ represents a group of atoms required to form a nitrogen-containing heterocyclic aromatic group; the suffix m represents an integer from 4 to 20;

the suffix n represents 0 or 1 with the proviso that n=1 when $L^3$ is an $—SO_2NR^5—$ group or a $—CONR^5—$ group;

the suffixes p and r each represents an integer from 1 to 20 and in general formula (IVb), p may be 0;

the suffix q represents 0 or 1;

$X^-$ represents a paired anion or a paired anion portion that forms an intramolecular salt. For example, $—SO_3^-$ portion in Compound A-24 or B-19 exemplified hereinafter corresponds to the paired anion portion.

DETAILED DESCRIPTION OF THE INVENTION

The compounds represented by general formulas (Ia) and (Ib) are described in detail below.

In general formulas (Ia) and (Ib), the aliphatic group represented by $R^1$ is preferably a $C_{1-30}$ aliphatic group, particularly preferably a $C_{1-20}$ straight-chain, branched or cyclic alkyl group.

In general formulas (Ia) and (Ib), the aromatic group represented by R: is a monocyclic or bicyclic aryl group or an unsaturated heterocyclic group. The unsaturated heterocyclic group may be condensed with aryl groups.

The aliphatic or aromatic group represented by $R^1$ may be substituted. Examples of suitable substituents for $R^1$ include an alkyl group, an aralkyl group, an alkenyl group, an alkinyl group, an alkoxy group, an aryl group, a substituted amino group, a ureide group, a urethane group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, a phosphoric amide group, a diacylamino group, and an imide group. Preferred substituents for Rare an alkyl group (preferably a $C_{1-20}$ alkyl group), an aralkyl group (preferably $C_{7-30}$ an aralkyl group), an alkoxy group (preferably a $C_{1-20}$ alkoxy group), a substituted amino group (preferably an amino group substituted by a $C_{1-20}$ alkyl group), an acylamino group (preferably a $C_{2-30}$ acylamino group), a sulfonamide group (preferably a $C_{1-30}$ sulfonamide group), a ureide group (preferably a $C_{1-30}$ ureide group), and a phosphoric amide group (preferably a $C_{1-30}$ phosphoric amide group). These substituent groups may be further substituted by other substituents.

The ethylene oxide group and the quaternary ammonium cation group or groups contained in $R^1$ may be included in these substituents.

$R^1$ is preferably a group that is represented by the following general formulas (IIa), (IIIa), (IVa) or (Va):

$$R^{11}—O—(CH_2CH_2O)_m—(CH_2)_p—(S—(CH_2)_r)_q— \quad \text{(IIa)}$$

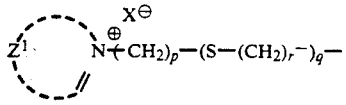

(IIIa)

-continued

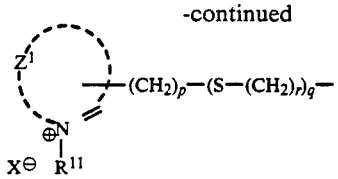

(IVa)

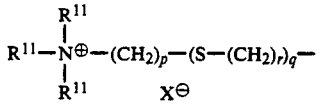

(Va)

In general formulas (IIa), (IIIa), (IVa) and (Va), $R^{11}$, $Z^1$, p, q, r, m, and X. each has the same meaning as defined in general formulas (IIb), (IIIb), (IVb) and (Vb).

In general formulas (IIa), (IIIa), (IVa), (Va), (IIb), (IIIb), (IVb) and (Vb), the aliphatic group represented by $R^{11}$ is preferably a $C_{1-30}$ aliphatic group, particularly preferably a $C_{1-20}$ straight-chain, branched or cyclic alkyl group. The aromatic group represented by $R^{11}$ is a monocyclic or bicyclic aryl group or an unsaturated heterocyclic group. The unsaturated heterocyclic group may be condensed with an aryl group or groups. The three $R^{11}$'s in general (Vb) may be the same or different or they may be connected to each other to form a ring. Examples of nitrogen-containing heterocyclic aromatic groups formed by $Z^1$ and a nitrogen atom include a pyridine ring, a pyrimidine ring, a pyridazine ring, a pyrazine ring, an imidazole ring, an oxazole ring, a thiazole ring, benzo-condensed rings thereof, a pteridine ring, and a naphthyridine ring. The suffixes p and r each represents an integer from 1 to 20, preferably from 2 to 10. In general formulas (IVa) and (IVb), p may be 0. $R^{11}$ and $Z^1$ may be substituted. Examples of suitable substituents for $R^{11}$ and $Z^1$ include those set forth as substituents for $R^1$ in general formulas (Ia) and (Ib).

In general formulas (Ia) and (Ib), the aliphatic group represented by $R^2$ and $R^3$ are preferably a $C_{1-30}$ aliphatic group, particularly preferably a $C_{1-20}$ straight-chain, branched or cyclic alkyl group.

In general formulas (Ia) and (Ib), the aromatic groups represented by $R^2$ and $R^3$ are a monocyclic or bicyclic aryl group or an unsaturated heterocyclic group. The unsaturated heterocyclic group may be condensed with an aryl group or groups.

The groups represented by $R^2$ and $R^3$ are preferably an aryl group, particularly preferably an aryl group containing benzene rings.

The aliphatic or aromatic groups represented by $R^2$ and $R^3$ may be substituted. Examples of suitable substituents include those set forth as substituents for $R^1$.

In general formulas (Ia) and (Ib), the alkyl group represented by $R^4$ is preferably a $C_{1-4}$ alkyl group, and the aryl group represented by $R^4$ is preferably a monocyclic or bicyclic aryl group (e.g., containing benzene rings).

If $G^1$ is —CO— group, then $R^4$ is preferably a hydrogen atom, an alkyl group (e.g., methyl, trifluoromethyl, 3-hydroxypropyl, 3-methanesulfonamidepropyl, phenylsulfonylmethyl), an aralkyl group (e.g., o-hydroxybenzyl), or an aryl group (e.g., phenyl, 3,5-dichlorophenyl, o-methanesulfonamidephenyl, 4-methanesulfonylphenyl, 2-hydroxymethylphenyl). A hydrogen atom is particularly preferred among these groups.

$R^4$ may be substituted. Examples of suitable substituents for $R^4$ include those set forth as substituents for $R^1$.

In general formulas (Ia) and (Ib), $G^1$ is most preferably a —CO— group.

$R^4$ may be a group which causes a cyclization reaction which allows the $G^1$—$R^4$ portion to be separated from the remainder of the molecule to form a cyclic structure containing —$G^1$—$R^4$. Examples of such groups for $R^4$ include those described in JP-A-63-29751 (the term "JP-A" as used herein means an "unexamined published Japanese patent application").

The group represented by $R^5$ is preferably a hydrogen atom or a $C_{1-6}$ alkyl group, particularly preferably a hydrogen atom. If the compound represented by general formulas (Ia) and (Ib) contains two or more $R^5$ groups or $G^2$ groups, they may be the same or different.

In general formulas (Ia) and (Ib), $R^1$, $R^2$, $R^3$, $R^4$ or $R^5$ may include a ballast group or a polymer which is commonly used in immobile photographic additives such as a coupler. A ballast group is a relatively photographically-inert group containing 8 or more carbon atoms. Suitable ballast groups may be selected from the group consisting of an alkyl group, an alkoxy group, a phenyl group, an alkylphenyl group, a phenoxy group, and an alkylphenoxy group. Examples of the above mentioned polymer include the polymers described in JP-A-1-100530.

In general formulas (Ia) and (Ib), $R^1$, $R^2$, $R^3$, $R^4$ or $R^4$ may include a group which facilitates the adsorption of the compound represented by general formulas (Ia) and (Ib) to the surface of the silver halide grains incorporated in the photographic material. Examples of such adsorption groups include the groups described in U.S. Pat. Nos. 4,385,108 and 4,459,347, and in JP-A-59-195,233, 59-200,231, 59-201,045, 59-201,046, 59-201,047, 59-201,048, 59-201,049, 61-170,733, 61-270,744, 62-948, 63-234,244, 63-234,245, and 63-234,246, such as a thiourea group, a heterocyclic thioamide group, a mercapto heterocyclic group and a triazole group.

Examples of the compounds represented by general formula (Ia) are given below, but the present invention should not be construed as being limited thereto.

A-1

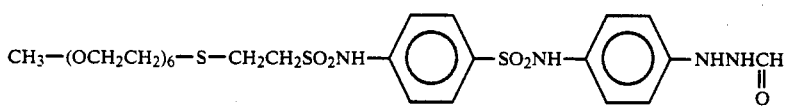

A-2

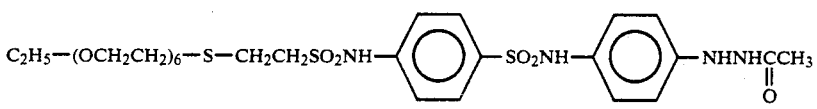

A-3

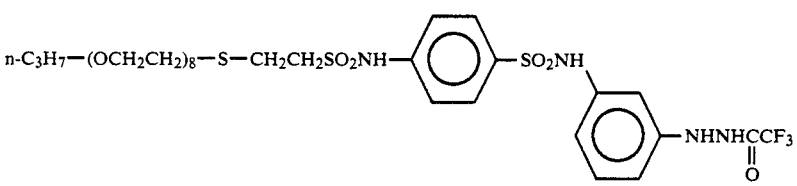

A-4

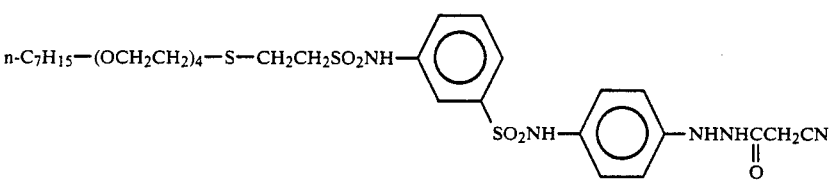

A-5

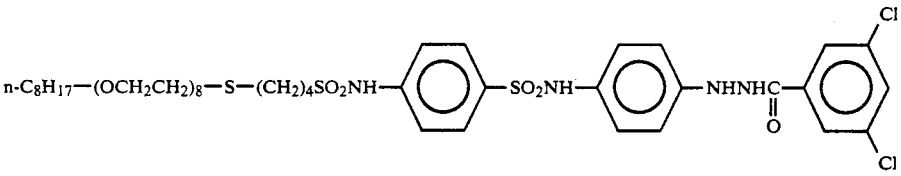

A-6

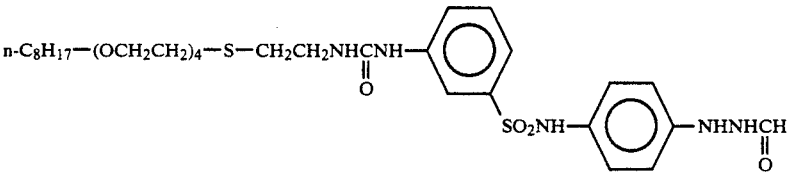

A-7

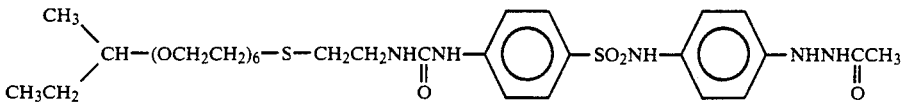

-continued
A-8
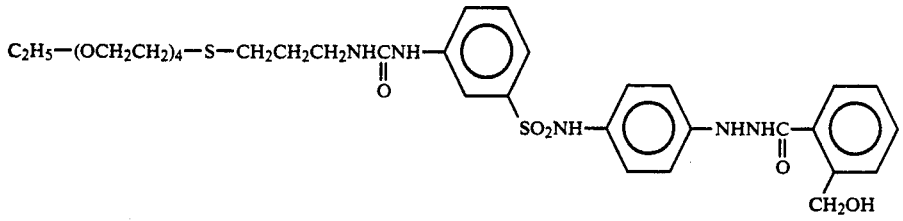
A-9
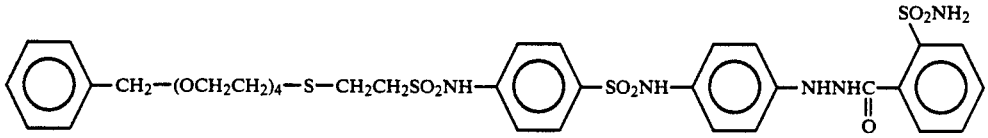
A-10
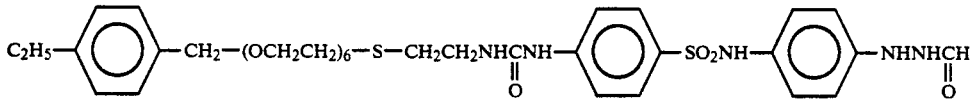
A-11
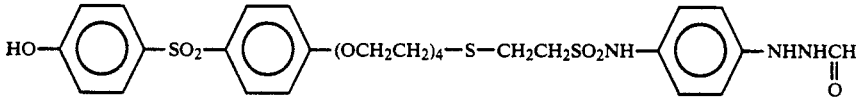
A-12
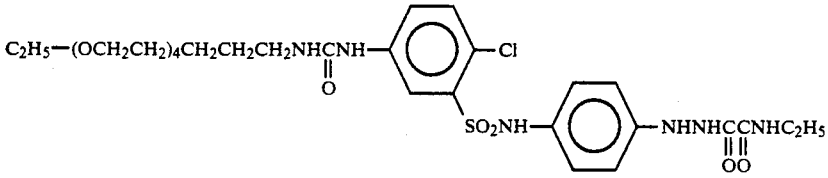
A-13
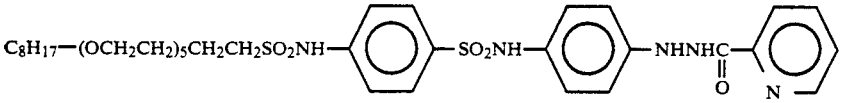
A-14
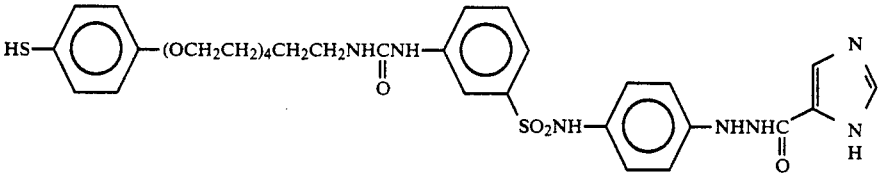
A-15
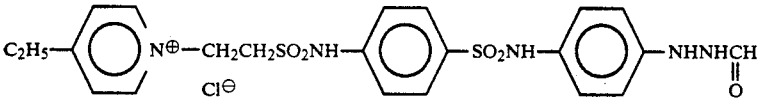
A-16
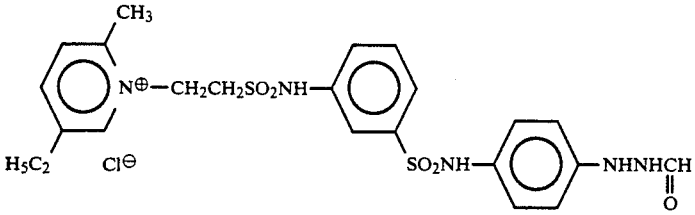
A-17
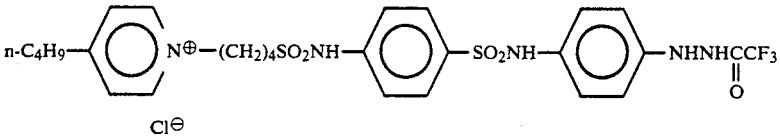

-continued
A-18
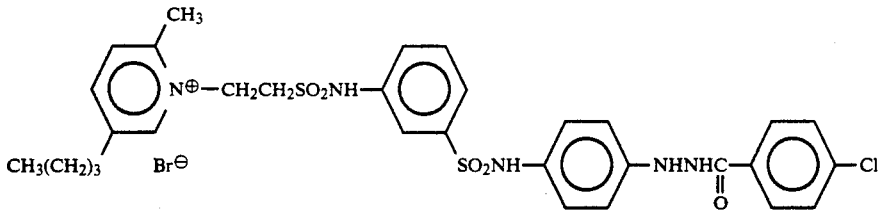
A-19
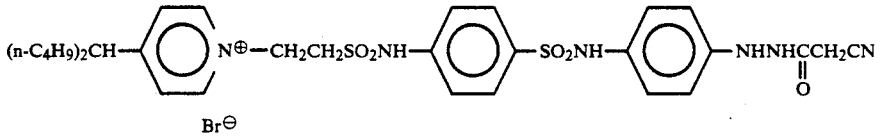
A-20
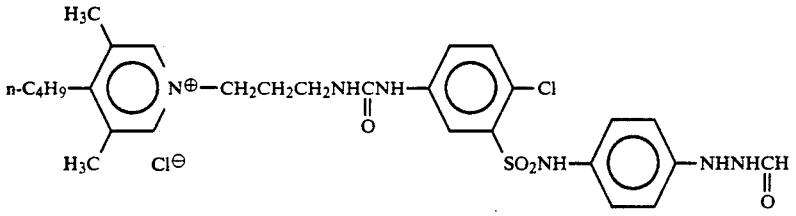
A-21
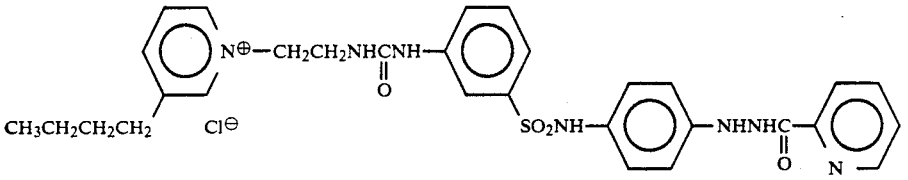
A-22
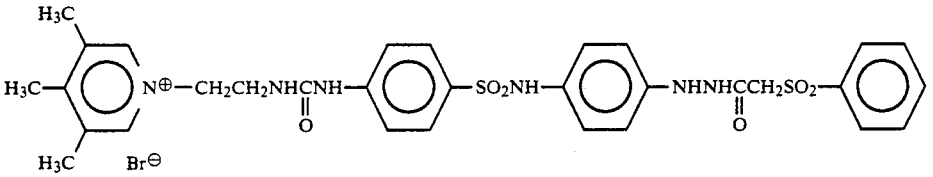
A-23
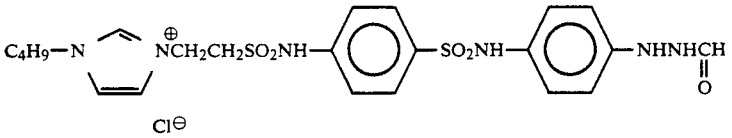
A-24
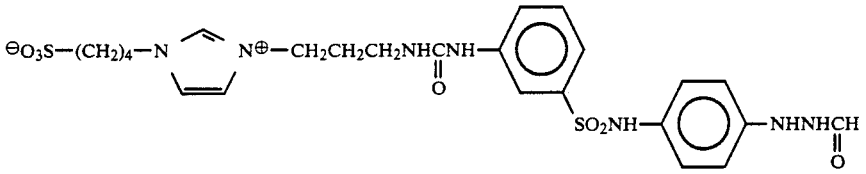
A-25
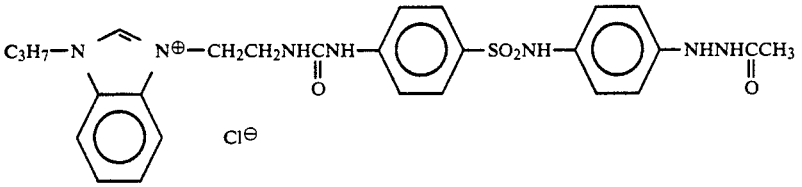

-continued
A-26
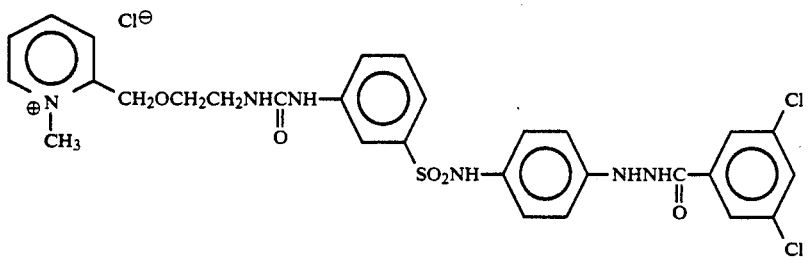
A-27
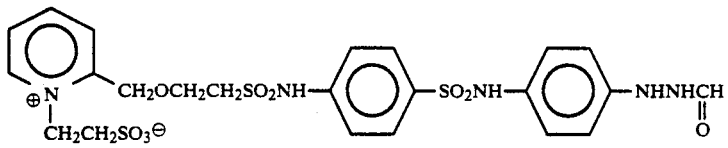
A-28
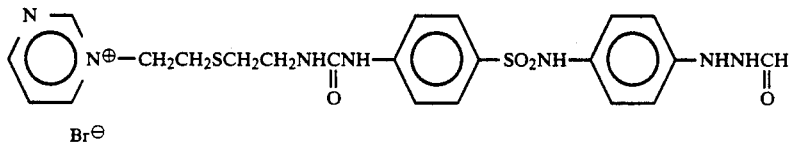
A-29
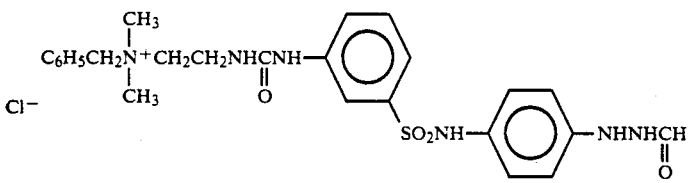
A-30
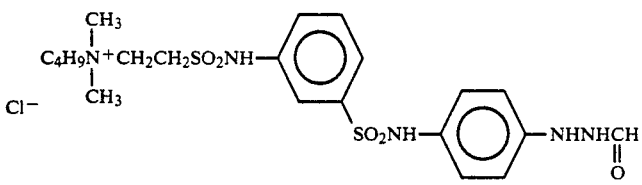
A-31
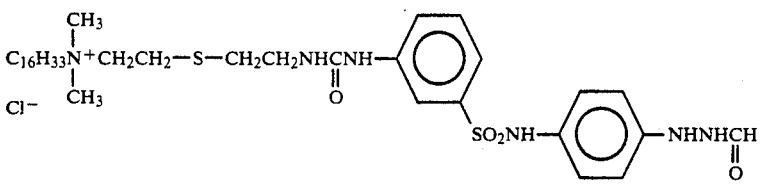
A-32
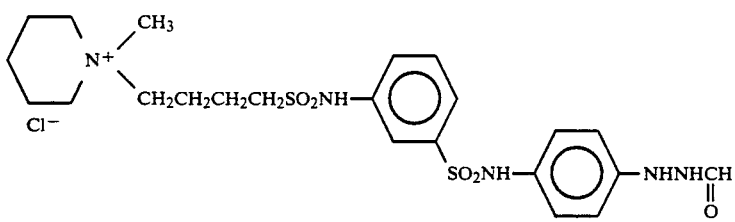
Examples of the compound represented by the general formula (1b) will be given below, but the present invention should not be construed as being limited thereto.
B-1
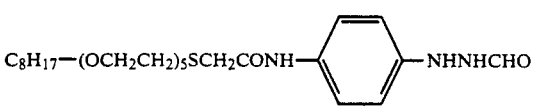

-continued
B-2
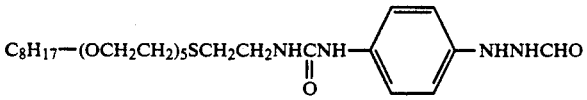
B-3
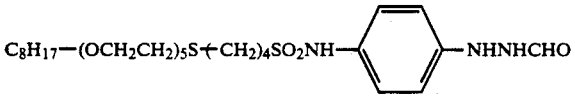
B-4
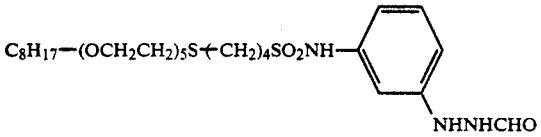
B-5
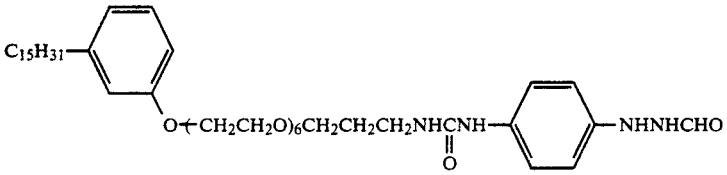
B-6
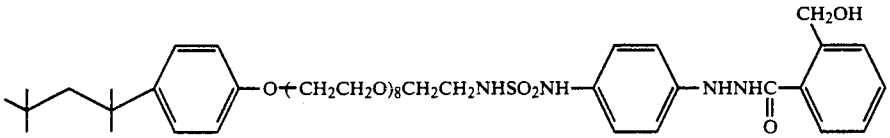
B-7
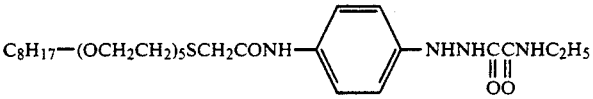
B-8
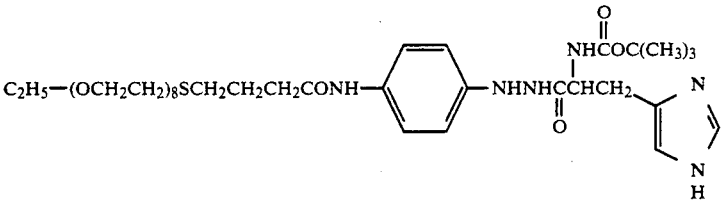
B-9
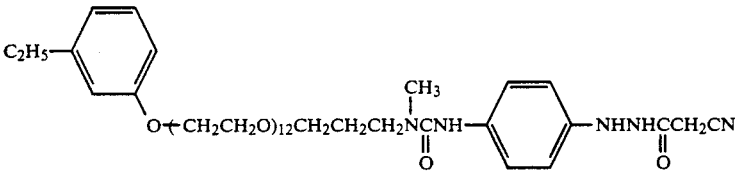
B-10
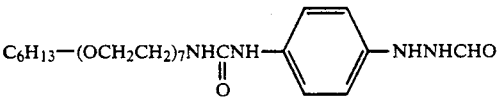
B-11
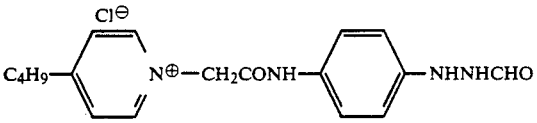
B-12
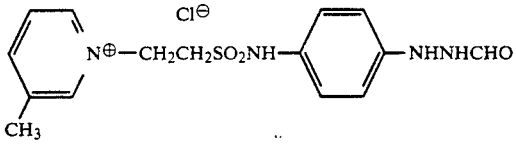

-continued
B-13
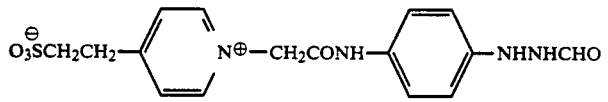
B-14
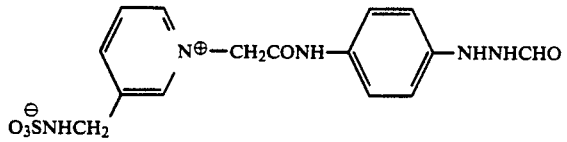
B-15
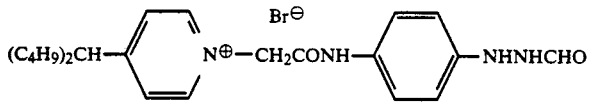
B-16
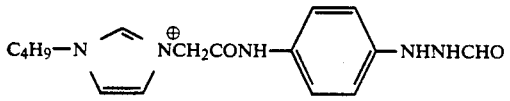
B-17
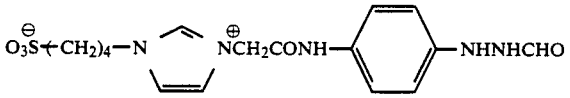
B-18
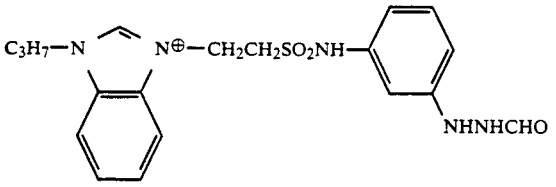
B-19
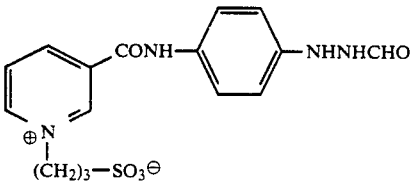
B-20
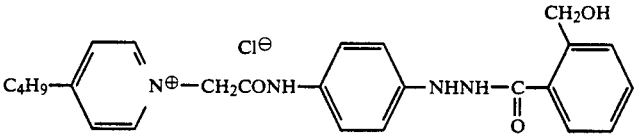
B-21
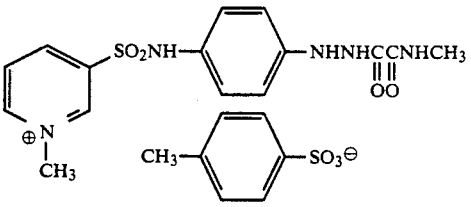
B-22
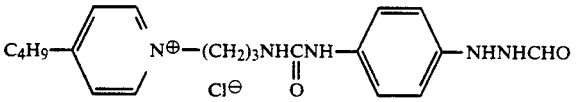

-continued

B-23

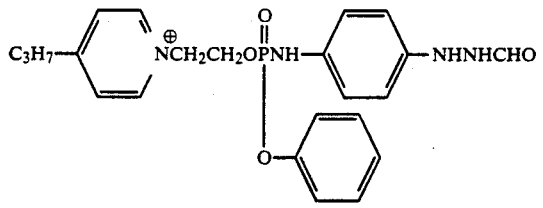

B-24

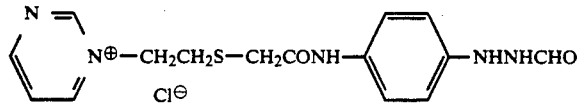

The hydrazine compounds of the present invention may be synthesized using the methods described in JP-A-61-213847, 62-260153, 49-129536, 56-153336, 56-153342 and 1-269936, U.S. Pat. Nos. 4,684,604, 3,379,529, 3,620,746, 4,377,634, 4,332,878, 4,988,604, and 4,994,365.

A specific example of a suitable synthesis method is set forth below.

SYNTHESIS EXAMPLE: Synthesis of Exemplary Compound A-6

18.4 g of imidazole and then 11.5 g of 2-chloroethylamine monohydrochloride were added to a mixture of 38.4 g of the starting compound A shown below and 150 ml of acetonitrile. The mixture was then stirred at room temperature for 2 hours. The reaction solution was poured into 500 ml of a 1N aqueous solution of HCl. The reaction solution was extracted with ethyl acetate, and then dried with magnesium sulfate anhydride. Ethyl acetate was then distilled off. The residue was then subjected to isolation and purification by silica gel chromatography to obtain 29.9 g of Synthetic Intermediate B.

Starting Compound A

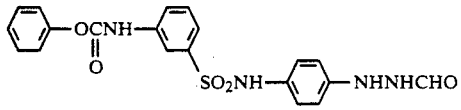

Synthetic Intermediate B

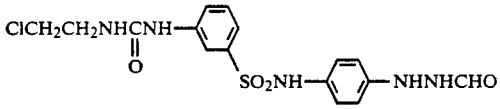

50 ml of a solution of 10.6 g of octyltetraethyleneoxythiol and dimethylformamide was cooled to 15° C. 1.6 g of 50% NaH was added to the solution, and then heated to room temperature. A solution of 12.4 g of the aforesaid Synthetic Intermediate B and dimethylformamide was added drop-wise and this reaction solution was stirred at room temperature overnight. The reaction solution was then poured into a 1N aqueous solution of HCl including ice. The reaction solution was extracted with ethyl acetate, washed with saturated brine, and then dried with magnesium sulfate anhydride. Ethyl acetate was then distilled off. The residue was then subjected to isolation and purification by silica gel chromatography to obtain 7.0 g of the desired compound A-6. The chemical structure of the compound was confirmed using NMR spectroscopy and IR spectroscopy.

The hydrazine derivatives of the present invention can be used in the form of solution in an appreprate water-miscible solvent such as an alcohol (e.g., methanol, ethanol, propanol, fluorinated alcohol), a ketone (e.g., acetone, methyl ethyl ketone), dimethylformamide, dimethylsulfoxide and methyl cellosolve.

A well known emulsion dispersion method can be used to dissolve the hydrazine compound in an oil such as dibutyl phthalate, tricresyl phosphate, glyceryl triacetate or diethyl phthalate or an auxiliary solvent such as ethyl acetate or cyclohexanone to mechanically prepare an emulsion dispersion. Alternatively, a solid dispersion method can be used to disperse a powdered hydrazine derivative of the present invention in water using a ball mill, a colloid mill or an ultrasonic apparatus.

Those skilled in the art will know how to make appropriate dispersion without undue experimentation.

The amount of the hydrazine derivative to be incorporated in the phototgraphic material of present invention is preferably in the range of $1\times10^{-6}$ mol to $5\times10^{-2}$ mol, particularly $1\times10^{-5}$ mol to $2\times10^{-2}$ mol per mol of silver halide.

In the present invention, if the compound represented by general formula (Ia) or (Ib) is to be incorporated in a photographic light-sensitive material, it is preferably incorporated in a silver halide emulsion layer but may be incorporated in any other light-insensitive hydrophilic colloidal layer (e.g., a protective layer, an interlayer, a filter layer, or an antihalation layer). If the compound is to be incorporated in a silver halide emulsion layer, it may be incorporated at any time between the beginning of chemical ripening and before coating, preferably after the completion of chemical ripening but before coating. In particular, the compound is preferably incorporated in a coating solution prepared for coating.

The silver halide emulsion to be used in the present invention may have any suitable composition such as silver chloride, silver bromochloride, silver bromoiodide and silver bromochloroiodide. In the case of light-sensitive materials for contact work, silver halide having a silver halide content of 60 mol % or more, particularly 75 mol % or more is preferably used. In particular, silver bromochloride or silver bromochloroiodide containing 0 to 5 % of silver bromide is preferably used.

In the case of light-sensitive materials for camera work, silver halide having a silver bromide content of 70 mol % or more, particularly 90 mol % or more is preferably used. The silver iodide content is preferably in the range of 10 mol % or less, particularly preferably 0.1 to 5 mol %.

The silver halide grains to be used in the present invention are preferably finely divided and have a small grain size (e.g., 0.7 μm or less, particularly 0.5 μm or less). The grain size distribution is not critial but is preferably monodisperse. The term "monodisperse emulsion" as used herein means an emulsion comprising grains at least 95% of which by weight or number have a grain size falling within ±40% from the average grain size.

The silver halide grains in the photographic emulsions may have a regular crystal form such as cubic and octahedral, or an irregular crystal form such as spherical and tabular, or a combination of these crystal forms. In particular, cubic grains are preferably used.

The silver halide grains may have a phase which is uniform throughout each grain or the grains may have phases that differ from core to shell. Two or more kinds of silver halide emulsions which have been separately prepared may be used in admixture.

In the processes for the forming and physically ripening the silver halide grains, cadmium salts, sulfites, lead salts, thallium salts, rhodium salts, or complex salts thereof, or iridium salts or complex salts thereof may be used in the system.

Examples of suitable rhodium salts include rhodium monochloride, rhodium dichloride, rhodium trichloride and ammonium hexachlororhodiumate. Preferably, a water-soluble halogeno complex compound of trivalent rhodium such as hexachlororhodiumic acid (III) or its salts (e.g., ammonium salt, sodium salt, potassium salt) is used.

The amount of the water-soluble rhodium salt to be added is generally in the range of $1.0\times10^{-8}$ mol to $1.0\times10^{-3}$ mol, preferably $1.0\times10^{-7}$ mol to $5.0\times10^{-4}$ mol per mol of silver halide.

The silver halide emulsion to be used in the present process may or may not be subjected to chemical sensitization. Processes for chemical sensitization of the silver halide emulsion include sulfur sensitization process, reduction sensitization processes and noble metal sensitization processes. These chemical sensitization processes can be used singly or in combination.

An example of a noble metal sensitization process is a gold sensitization process. In the gold sensitization process, a gold compound is used, typically a gold complex salt. Noble metals other than gold, such as platinum, palladium and iridium can be included. Specific examples of suitable compounds are described in U.S. Pat. No. 2,448,060 and British Patent 618,061.

Suitable sulfur sensitizers include sulfur compounds contained in gelatin, and various sulfur compounds such as thiosulfate, thiourea, thiazole and rhodanine, etc.

Suitable reduction sensitizers include stannous salts, amines, formamidinesulfinic acid, silane compounds, etc.

The silver halide emulsion layer to be used in the present invention may include a spectral sensitizing dye. Useful examples of suitable spectral sensitizing dyes include combinations of useful sensitizing dyes and supersensitizing dyes, and supersensitizing substances as disclosed in Research Disclosure No. 17643, vol. 176, December 1978, IV-J, page 23.

Gelatin is preferably used as a binder or protective colloid to be incorporated in the hydrophilic emulsion. Other hydrophilic colloids may be used. Examples of suitable hydrophilic colloids which can be used in the present invention include proteins such as gelatin derivatives, graft polymers of gelatin with other high molecular compounds, albumine, and casein, saccharide derivatives such as hydroxyethyl cellulose, carboxymethyl cellulose, cellulose ester sulfate, sodium alginate, and starch derivatives, monopolymers or copolymers such as polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole, and other various synthetic hydrophilic high molecular compounds.

As gelatin there may be used lime-treated gelatin as well as acid-treated gelatin. Furthermore, hydrolyzates of gelatin and enzymatic decomposition products of gelatin can be used.

The light-sensitive material of the present invention may include various compounds to inhibit fogging during the preparation, storage or photographic processing of the light-sensitive material or to stabilize photographic properties. Many compounds are suitable for use as fog inhibitors or stabilizers. Examples of suitable fog inhibitors or stabilizers include azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles and nitrobenzotriazoles, mercaptopyrimidines, mercaptotriadines, thioketo compounds such as oxazolinethione, azaindenes such as triazaindenes, tetraazaindenes (particularly 4-hydroxy-substituted (1,3,3a,7)tetraazaindenes), and pentaazaindenes, hydroquinone and derivatives thereof, disulfides such as thioctic acid, benzenethiosulfonic acid, benzenesulfinic acid, and benzenesulfonic amide. Among these compounds, benzotriazoles (e.g., 5-methyl-benzotriazole) and nitroindazoles (e.g., 5-nitroindazole) are preferred. These compounds may be incorporated in a processing solution.

The light-sensitive material of the present invention may include an organic desensitizer.

The organic desensitizer preferably contains at least one water-soluble group and alkali-dissociative group.

Suitable preferred organic desensitizers are exemplified in JP-A-63-64039. If such an organic desensitizer is to be used, it is preferably incorporated in a silver halide emulsion layer in an amount of from $1.0\times10^{-8}$ mol/m$^2$ to $1.0\times10^{-4}$ mol/m$^2$, preferably $1.0\times10^{-7}$ mol/m$^7$ to $1.0\times10^{-5}$ mol/m$^2$ of the photographic material.

The light-sensitive material of the present invention may include a development accelerator.

Development acceleratos or nucleation infectious development accelerators suitable for use in the present invention include the compounds disclosed in JP-A-53-77616, 54-37732, 53-137133, 60-140340, and 60-14959 as well as various compounds containing nitrogen or sulfur atoms.

Specific examples of development accelerator compounds are given below.

(1)
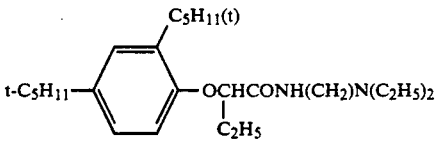
(2)
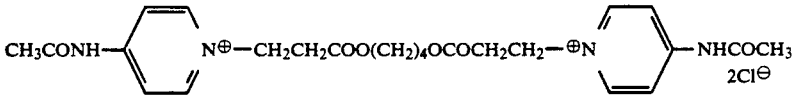
(3)
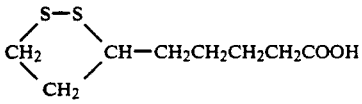
(4)
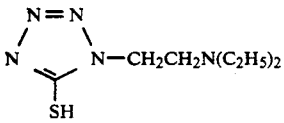
(5)
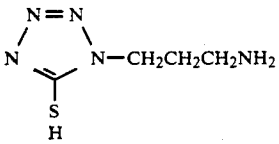
(6)
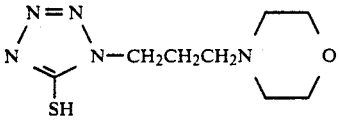
(7)
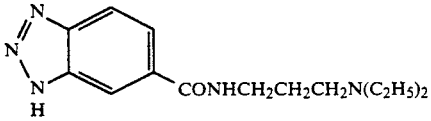
(8)
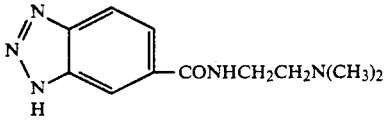
(9)
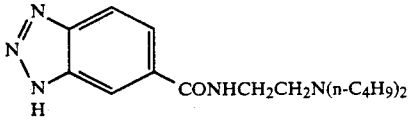
(10)
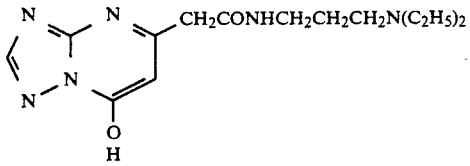
(11)
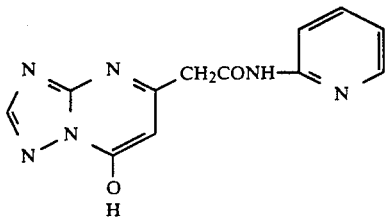

-continued

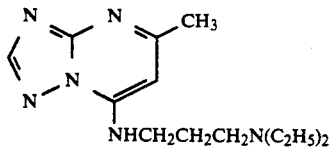

(12)

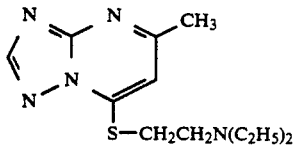

(13)

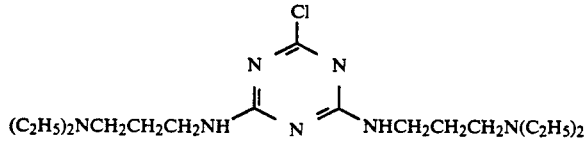

(14)

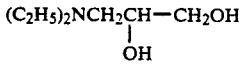

(15)

n-$C_4H_9N(C_2H_4OH)_2$ (16)

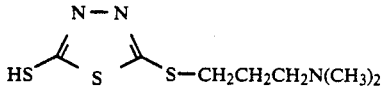

(17)

The development accelerator is generally used in an amount of from $1.0\times10^{-3}$ g/m$^2$ to 0.5 g/m$^2$, preferably $5.0\times10^{-3}$ to 0.1 g/m$^2$, though the amount will vary depending on the characteristics of the particular development accelerator. The development accelerator may be incorporated in a coating solution in the form of solution where the development accelerater is dissloved in an appropriate solvent such as water, an alcohol (e.g., methanol, ethanol), acetone, dimethylformamide or methyl cellosolve.

A plurality of such additives may be used in combination.

The emulsion layers of the present invention or other hydrophilic colloidal layers may include a water-soluble dye as a filter dye or for the purpose of inhibiting irradiation or other various purposes. Suitable filter dyes include dyes for further lowering photographic sensitivity, preferably an ultraviolet absorbent having a maximum spectral absorption in the inherent sensitivity range of silver halide or a dye having a substantial light absorption in the range of 310 nm to 600 nm for improving the safety to safelight when treated as daylight light-sensitive material.

These dyes may preferably be incorporated in an emulsion layer or in a layer above the silver halide emulsion layer, i.e., a light-insensitive hydrophilic colloidal layer located farther from the support than the silver halide emulsion layer, together with a mordant.

The amount of such a dye to be incorporated depends on its molar absorptivity and is normally in the range of $10^{-3}$ g/m$^2$ to 1 g/m$^2$, preferably 10 mg/m$^2$ to 500 mg/m$^2$.

These dyes may be incorporated in a coating solution in the form of solution where the dyes are dissloved in an appropriate solvent such as water, an alcohol (e.g., methanol, ethanol, propanol), acetone, or methyl cellosolve or a mixture thereof.

Two or more kinds of these dyes may be used in combination.

Specific examples of these dyes are described in JP-A-63-64039.

In addition, ultraviolet absorbing dyes as disclosed in U.S. Pat. Nos. 3,533,794, 3,314,794, 3,352,681, 3,705,805, 3,707,375, 4,045,229, 3,700,455, and 3,499,762, JP-A-46-2784, and West German Patent Publication 1,547,863 can also be used.

Other dyes which can be used include pyrazolone oxazole dyes as disclosed in U.S. Pat. No. 2,274,782, diarylazo dyes as disclosed in U.S. Pat. No. 2,956,879, styryl dyes and butadienyl dyes as disclosed in U.S. Pat. Nos. 3,423,207 and 3,384,487, melocyanine dyes as disclosed in U.S. Pat. No. 2,527,583, melocyanine dyes and oxonol dyes as disclosed in in U.S. Pat. Nos. 3,486,897, 3,652,284, and 3,718,472, enaminohemioxonol dyes as disclosed in U.S. Patent 3,976,661, and dyes as disclosed in British Patents 584,609 and 1,177,429, JP-A-48-85130, 49-99620, and 49-114420, and U.S. Pat. Nos. 2,533,472, 3,148,187, 3,177,078, 3,247,127, 3,540,887, 3,575,704, and 3,653,905.

The photographic light-sensitive material of the present invention may contain an inorganic or organic film hardener in a photographic emulsion layer or other hydrophilic colloidal layer. For example, chromium salts (e.g., chromium alum, chromium acetate), aldehydes (e.g., formaldehyde, glyoxal, glutaraldehyde), N-methylol compounds (e.g., dimethylolurea, methylol dimethyl hydantoin), dioxane derivatives (e.g., 2,3-dihydroxydioxane), activated vinyl compounds (e.g., 1,3,5-triacryloyl-hexahydro-s-triazine, 1,3-vinylsulfonyl-2-propanol), activated halogen compounds (e.g., 2,4-dichloro-6-hydroxy-s-triazine), mucohalogenic acids (e.g., mucochloric acid, mucophenoxychloric acid), epoxy compounds (e.g., tetramethylene glycol diglycidyl ether), and isocyanate compounds (e.g., hexamethylene diisocyanate) may be used singly or in combination.

Furthermore, high molecular weight film hardeners as disclosed in JP-A-56-66841, British Patent 1,322,971, and U.S. Pat. No. 3,671,256 can be used.

The photographic emulsion layer or other hydrophilic colloidal layers in the light-sensitive material prepared according to the present invention may include various surfactants to facilitate coating, inhibit electrification, improve emulsion dispersion and adhesion, and improving slipperiness and photographic properties (e.g., accelerating development, improving contrast, sensitization).

Examples of suitable surfactants include nonionic surfactants such as saponin (steroid series), alkylene oxide derivatives (e.g., polyethylene glycol, polyethylene glycol/polypropylene glycol condensate, polyethylene glycol alkyl ether or polyethylene glycol alkylaryl ether, polyethylene glycol ester, polyethylene glycol sorbitan ester, polyalkylene glycol alkylamide or amide, and polyethylene oxide addition products of silicone), glycidol derivatives (e.g., polyglyceride alkenylsuccinate and alkylphenol polyglyceride), aliphatic esters of polyvalent alcohols, or alkylesters of saccharides. Examples of suitable anionic surfactants include anionic surfactants containing acid groups such as a carboxyl group, a sulfo group, a phospho group, an ester sulfate group or an ester phosphate group (e.g., alkylcarboxylate, alkylsulfonate, alkylbenzenesulfonate, alkylnaphthalenesulfonate, alkylsulfuricester, alkylphosphoric ester, N-acyl-N-alkyltaurine, sulfosuccinic ester, sulfoalkyl polyoxyethylenealkylphenyleher, and polyoxyethylenealkylphosphoric ester). Other suitable surfactants include amphoteric surfactants such as amino acids, aminoalkylsulfonic acids, aminoalkylsufuric or phosphoric esters, alkylbetaines and amine oxides, and cationic surfactants such as alkylamine salts, aliphatic or aromatic quaternary ammonium salts, heterocyclic quaternary ammonium salts (e.g., pyridinium and imidazolium), and aliphatic or heterocyclic group-containing phosphonium or sulfonium salts.

Surfactants which can particularly preferably be used in the present invention are polyalkylene oxides having a molecular weight of 600 or more as described in JP-B-58-9412 (the term "JP-B" as used herein means an "examined Japanese patent publication"). For the purpose of dimensional stability, a polymer latex such as a polyalkyl acrylate may be incorporated in the system.

In order to obtain an ultrahigh contrast image using the silver halide photographic material of the present invention, a stable developer can be used rather than conventional infectious developers or high alkali developers having a pH value of about 13 such as described in U.S. Pat. No. 2,419,975.

In other words, the silver halide photographic material of the present invention can be processed with a developer containing sulfite ions as preservatives in an amount of 0.15 mol/l or more and having a pH value of 10.5 to 12.3, particularly 11.0 to 12.0 to obtain a sufficiently ultrahigh negative image.

The developing agents that may be used to develop the photographic material of the present process are not specifically limited. For example, dihydroxybenzenes (e.g., hydroquinone), 3-pyrazolidones (e.g., 1-phenyl-3-pyrazolidone and 4,4-dimethyl-1-phenyl-3-pyrazolidone), aminophenols (e.g., N-methyl-p-aminophenol), etc. can be used singly or in combination.

The silver halide photographic material of the present invention is particularly adapted to be processed with a developer containing dihydroxybenzenes as main developing agents and 3-pyrazolidones or aminophenols as auxiliary developing agents. Preferably, the developer contains dihydroxybenzenes in an amount of 0.05 to 0.5 mol/l and 3-pyrazolidones or aminophenols in an amount of 0.06 mol/l or less.

As described in U.S. Pat. No. 4,269,929, amines can be incorporated in the developer to raise the development speed and shorten the development time.

The developer may further contain a pH buffer such as a sulfite, a carbonate, a borate or phosphate of an alkali metal, a development inhibitor such as bromide or iodide, an organic fog inhibitor (particularly nitroindazoles or benzotriazoles), a fog inhibitor, etc. As necessary, water softeners, dissolution aids, color toners, development accelerators, surfactants (particularly the above mentioned polyalkylene oxides), antifoaming agents, film hardeners, film silver stain inhibitors (e.g., 2-mercaptobenzimidazolesulfonic acids), etc. may be incorporated in the developer.

As a fixing agent, commonly used compositions are acceptable. Suitable fixing agents include thiosulfates or thiocyanates as well as organic sulfur compounds known to serve as fixing agents. The fixing agent to be used in the present invention may contain a water-soluble aluminum compound as a film hardener.

The processing temperature in the present invention can be normally selected from 18° C. to 50° C.

The photographic processing is preferably effected by means of an automatic processor. In accordance with the present invention, even if the total processing time between the entrance and exit of the light-sensitive material from the automatic processor is set between 90 seconds and 120 seconds, a sufficiently ultrahigh contrast negative gradation photograph can be obtained.

The developer to be used in the present invention may include as a silver stain inhibitor a compound as described in JP-A-56-24347. As a solubilization agent to be incorporated in the developer, the compounds as described in JP-A-61-267759 may be used. Further, as a pH buffer to be incorporated in the developer, the compounds as described in JP-A-60-93433 and JP-A-62-186259 may be used.

The present invention is further described in the following examples, but the invention should not be construed as being limited thereto.

EXAMPLE 1

1) Preparation of Coated Samples

An aqueous solution of silver nitrate and an aqueous solution of sodium chloride were simultaneously added to an aqueous solution of gelatin which had been kept at a temperature of 40° C. in the presence of $(NH_4)_3RhCl_6$ in an amount of $5.0\times10^{-6}$ mol per mol of silver. Soluble salts were removed from the system by a method well known in the art. Gelatin was then added to the system. As a stabilizer, 2-methyl-4-hydroxy-1,3,3a,7-tetrazindene was added to the system without chemical ripening. As a result, a monodisperse emulsion of cubic crystals having an average grain size of 0.2 μm was obtained.

The emulsion was divided its coating samples and a hydrazine compound selected from the compounds represented by general formulas (Ia) and (Ib) and set forth in Table 1 below or a comparative compound was added to each sample in an amount set forth in Table 1. The comparative compounds have the following structural formulas:

Comparative Compound A (Compound I-6 described in U.S. Pat. No. 4,988,604)

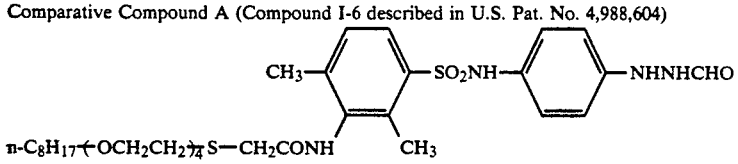

Comparative Compound B (Compound I-6 described in U.S. Pat. No. 4,994,365)

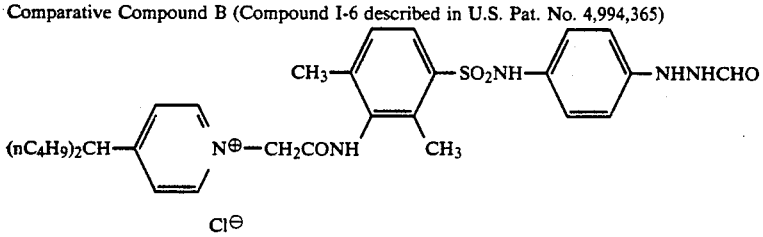

Comparative Compound C

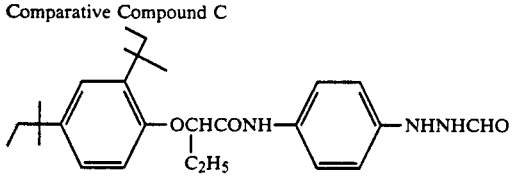

Comparative Compound D (Compound (6) described in JP-A-62-73256)

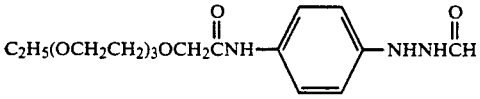

Comparative Compound E (Compound (11) described in JP-A-62-73256)

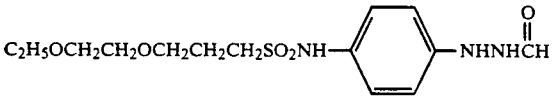

The following nucleation accelerator was added to each emulsion coating sample in an amount of 15 mg/m$^2$:

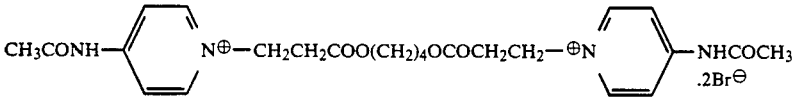

A polyethyl acrylate latex in an amount of 30 wt. % based on gelation as calculated in terms of the solids content and 1,3-di-vinylsulfonyl-2-propanol as a film hardener were also added to each emulsion coating sample.

Each emulsion coating sample was then coated on a polyester support in an amount of 3.8 g/m$^2$ on a silver basis and 1.8 g/m$^2$ on a gelatin basis. A protective layer was coated a layer comprising gelatin in an amount of 1.5 g/m$^2$ and polymethyl methacrylate having a grain diameter of 2.5 μm was then coated on each emulsion layer in an amount of 0.3 g/m$^2$.

2) Evaluation of Photographic Properties

The coated samples thus obtained were each image-wise exposed to light through an original as shown in FIG. 1 in JP-A-2-293736 in a daylight printer P-627FM produced by Dainippon Screen Mfg. Co., Ltd. The exposed samples were then developed with Developer A whose composition is shown below by means of an automatic processor model FG710NH produced by Fuji Photo Film Co., Ltd. at a temperature of 38° C. for 20 seconds, fixed with a fixing solution GR-F1 produced by Fuji Photo Film Co., Ltd., rinsed, and then dried.

| Developer A | |
|---|---|
| Hydroquinone | 50.0 g |
| N-methyl-p-aminophenol | 0.3 |
| Sodium hydroxide | 18.0 |
| Potassium hydroxide | 55.0 |
| 5-Sulfosalicylic acid | 45.0 |
| Potassium sulfite | 110.0 |
| Disodium ethylenediaminetetraacetate | 1.0 |
| Potassium bromide | 10.0 |
| 5-Methylbenzotriazole | 0.4 |
| 2-Mercaptobenzimidazole-5-sulfonic acid | 0.3 |
| Sodium 3-(5-mercaptotetrazole) benzenesulfonate | 0.2 |
| N-n-butyl diethanolmaine | 15.0 |
| Sodium toluenesulfonate | 8.0 |
| Water to make | 1 l |
| pH (adjusted with potassium hydroxide) | 11.6 |

The letter image quality of each sample was evaluated on a scale of 1 to 5. On this scale, 5 denotes an excellent letter image quality which enables reproduction of 30-μm wide letters when exposure is effected through an original as shown in FIG. 1 of JP-A-2-293736 as mentioned above in such a manner that a 50% dot area in the original reproduced as a 50% dot area on a light-sensitive material for contact work. On the opposite end of the scale, 1 denotes a poor letter image quality which can only reproduce letters having a width of 150 μm or more under the same exposure conditions. Extract letter image qualities 4, 3 and 2 denote intermediate extract letter image qualities determined by organoleptic examination. A letter image quality of 3 or higher equates to an image quality suitable for practical use.

The Dmax for each sample was also evaluated. Dmax represents the maximum density value obtained when the sample was exposed in such a manner that a 50% dot area on the original was reproduced as a 50% dot area on a light-sensitive material for contact work.

Table 1 shows the letter image quality and Dmax for each sample. The results in Table 1 show that the samples embodying the present invention exhibit excellent extract letter image qualities and high Dmax values.

TABLE 1

| Sample | Compound | Added amount (mol/mol Ag) | Dmax | Letter image quality |
|---|---|---|---|---|
| 1 Comparison | Comparative Compound A | $1.5 \times 10^{-3}$ | 3.3 | 4 |
| 2 Comparison | Comparative Compound B | $1.5 \times 10^{-3}$ | 3.2 | 3 |
| 3 Comparison | Comparative Compound C | $1.5 \times 10^{-3}$ | 2.9 | 3 |
| 4 Invention | Compound A-1 | $1.5 \times 10^{-3}$ | 3.5 | 5 |
| 5 Invention | Compound A-6 | $1.5 \times 10^{-3}$ | 3.7 | 5 |
| 6 Invention | Compound A-8 | $1.5 \times 10^{-3}$ | 3.8 | 5 |
| 7 Invention | Compound A-16 | $1.5 \times 10^{-3}$ | 3.4 | 5 |
| 8 Invention | Compound A-23 | $1.5 \times 10^{-3}$ | 3.4 | 5 |
| 9 Comparison | Comparative Compound A | $0.37 \times 10^{-3}$ | 2.3 | 3 |
| 10 Comparison | Comparative Compound A | $0.75 \times 10^{-3}$ | 3.1 | 4 |
| 11 Comparison | Comparative Compound A | $1.5 \times 10^{-3}$ | 3.3 | 4 |
| 12 Comparison | Comparative Compound B | $0.37 \times 10^{-3}$ | 2.5 | 2 |
| 13 Comparison | Comparative Compound B | $0.75 \times 10^{-3}$ | 3.1 | 3 |
| 14 Comparison | Comparative Compound B | $1.5 \times 10^{-3}$ | 3.2 | 3 |
| 15 Comparison | Comparative Compound C | $0.37 \times 10^{-3}$ | 1.9 | 1 |
| 16 Comparison | Comparative Compound C | $0.75 \times 10^{-3}$ | 2.5 | 2 |
| 17 Comparison | Comparative Compound C | $1.5 \times 10^{-3}$ | 2.9 | 3 |
| 18 Comparison | Comparative Compound D | $0.37 \times 10^{-3}$ | 1.9 | 1 |
| 19 Comparison | Comparative Compound D | $0.75 \times 10^{-3}$ | 2.4 | 2 |
| 20 Comparison | Comparative Compound D | $1.5 \times 10^{-3}$ | 2.8 | 3 |
| 21 Comparison | Comparative Compound E | $0.37 \times 10^{-3}$ | 2.0 | 2 |
| 22 Comparison | Comparative Compound E | $0.75 \times 10^{-3}$ | 2.9 | 3 |
| 23 Comparison | Comparative Compound E | $1.5 \times 10^{-3}$ | 3.0 | 3 |
| 24 Invention | Compound B-1 | $0.20 \times 10^{-3}$ | 3.1 | 3 |
| 25 Invention | Compound B-1 | $0.37 \times 10^{-3}$ | 3.3 | 3 |

TABLE 1-continued

| Sample | Compound | Added amount (mol/mol Ag) | Dmax | Letter image quality |
|---|---|---|---|---|
| 26 Invention | Compound B-1 | $0.75 \times 10^{-3}$ | 3.6 | 5 |
| 27 Invention | Compound B-2 | $0.20 \times 10^{-3}$ | 2.6 | 3 |
| 28 Invention | Compound B-2 | $0.37 \times 10^{-3}$ | 3.1 | 4 |
| 29 Invention | Compound B-2 | $0.75 \times 10^{-3}$ | 3.9 | 5 |
| 30 Invention | Compound B-3 | $0.20 \times 10^{-3}$ | 2.8 | 4 |
| 31 Invention | Compound B-3 | $0.37 \times 10^{-3}$ | 3.6 | 4 |
| 32 Invention | Compound B-3 | $0.75 \times 10^{-3}$ | 4.1 | 5 |
| 33 Invention | Compound B-6 | $0.20 \times 10^{-3}$ | 2.9 | 3 |
| 34 Invention | Compound B-6 | $0.37 \times 10^{-3}$ | 3.6 | 4 |
| 35 Invention | Compound B-6 | $0.75 \times 10^{-3}$ | 3.8 | 5 |
| 36 Invention | Compound B-11 | $0.37 \times 10^{-3}$ | 3.0 | 3 |
| 37 Invention | Compound B-11 | $0.75 \times 10^{-3}$ | 3.5 | 3 |
| 38 Invention | Compound B-11 | $1.5 \times 10^{-3}$ | 3.6 | 5 |
| 39 Invention | Compound B-22 | $0.37 \times 10^{-3}$ | 2.9 | 3 |
| 40 Invention | Compound B-22 | $0.75 \times 10^{-3}$ | 3.5 | 3 |
| 41 Invention | Compound B-22 | $1.5 \times 10^{-3}$ | 3.5 | 5 |

EXAMPLE 2

Preparation of Light-Sensitive Emulsion

An aqueous solution of silver nitrate, an aqueous solution of potassium iodide and an aqueous solution of potassium bromide were simultaneously added over 60 minutes to an aqueous solution of gelatin which had been kept at a temperature of 50° C. in the presence of hexachlorinated iridium (III) potassium in an amount of $4 \times 10^{-7}$ mol per mol of silver and ammonia while the pAg value of the system was kept at 7.8 to prepare a monodisperse emulsion of cubic grains having an average grain size of 0.28 μm and an average silver iodide content of 0.3 mol %. The emulsion was desalted using a flocculation method. An inert gelatin was then added to the emulsion in an amount of 40 g per mol of silver. The emulsion was kept at a temperature of 50° C. while a KI solution ($10^{-3}$ mol/mol Ag) of 5,5'-dichloro-9-ethyl-3,3'-bis(3-sulfopropyl)oxacarboncyanine as a sensitizing dye was added to the emulsion. The emulsion was allowed to stand for 15 minutes, and then cooled down.

Coating of Light-Sensitive Emulsion Layer

The emulsion was subjected to re-dissolution and divided into coating samples. A hydrazine compound represented by general formula (Ia) or (Ib) or a comparative compound was added to each sample at a temperature of 40° C. and in an amount set forth in Table 2. 5-methylbenzotriazole, 2-methyl-4-hydroxy-1,3,3a,7-tetrazaindene, the following compounds (a) and (b), polyethyl acrylate in an amount of 30 wt. % based on gelatin, and the following compound (c) as a gelatin hardener were further added to each emulsion coating sample. Each emulsion coating sample was then coated on a 150-μm thick polyethylene terephthalate film having a 0.5-μm thick subbing layer comprising a vinylidene chloride copolymer in an amount of 3.8 g/m² on a silver basis.

Compound (a)

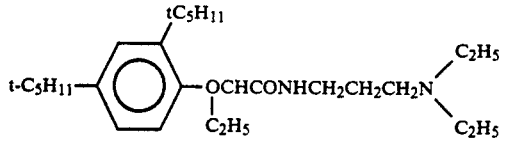

3.5 mg/m²

Compound (b)

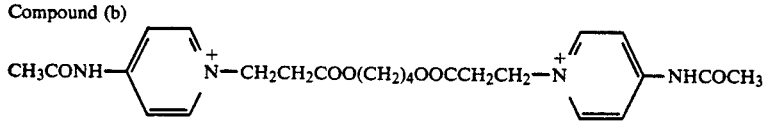

15.0 mg/m²

Compound (c)

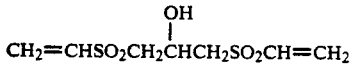

2.0 wt. % based on gelatin

Coating of Protective Layer

The emulsion layer of each sample was then coated with gelatin in an amount of 1.5 g/m², polymethyl methacrylate grains having an average grain diameter of 2.5 μm in an amount of 0.3 g/m², and finely divided AgCl grains having an average grain diameter of 0.08 μm in an amount such that the amount of silver reached 0.3 g/m² in the presence of the following surfactants.

Surfactants

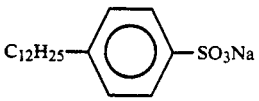

37 mg/m²

$CH_3COOC_6H_{13}$
|
$CHCOOC_6H_{13}$
|
$SO_3Na$ 37 mg/m²

$C_8F_{17}SO_2NCH_2COOK$
|
$C_3H_7$ 2.5 mg/m²

Evaluation of Properties

Each sample was exposed to tungsten light of 3,200° K. through an optical wedge and a contact screen (150 L chain dot type, produced by Fuji Photo Film Co., Ltd.), developed with the following Developer B at a temperature of 34° C. for 30 seconds, fixed, rinsed, and then dried.

| Developer B | |
|---|---|
| Hydroquinone | 50.0 g |
| N-methyl-p-aminophenol | 0.3 |
| Sodium hydroxide | 18.0 |
| Potassium hydroxide | 20.0 |
| Potassium sulfite | 30.0 |
| Disodium ethylenediaminetetraacetate | 1.0 |
| Potassium bromide | 10.0 |
| 5-Methylbenzotriazole | 0.4 |
| 2-Mercaptobenzimidazole-5-sulfonic acid | 0.3 |
| Sodium 3-(5-mercaptotetrazole) benzenesulfonate | 0.2 |
| N-n-butyl diethanolmaine | 7.0 |
| Sodium toluenesulfonate | 8.0 |

-continued

| Developer B | |
|---|---|
| Water to make | 1 l |
| pH (adjusted with potassium hydroxide) | 10.7 |

The halftone dot quality of each sample was evaluated visually and ralted on a scale of 1 to 5. On this scale, 5 is excellent and 1 is poor. Dot qualities of 5 and 4 are practicable for plate-making dot precursors. A halftone dot quality of 3 is the lowest practicable level. Dot qualities 2 and 1 are impracticable levels.

The Dmax for each sample was also evaluated. Dmax represents the optical density (Dmax) of an area which has been exposed at an exposure ($0.5+\log E_3$) 0.5 higher than the exposure ($\log E_3$) which gives an optical density of 1.5 on a specimen which has been similarly exposed to light through an optical wedge and then developed.

The results for each sample are set forth in Table 2. The results in Table 2 show that the samples embodying the present invention had high Dmax values and high dot qualities as compared with the comparative samples.

TABLE 2

| Sample | Compound | Added amount (mol/mol Ag) | Dmax | Halftone dot quality |
|---|---|---|---|---|
| 42 Comparison | Comparative Compound A | $0.8 \times 10^{-3}$ | 2.2 | 3 |
| 43 Comparison | Comparative Compound B | $0.8 \times 10^{-3}$ | 2.0 | 2 |
| 44 Comparison | Comparative Compound C | $0.8 \times 10^{-3}$ | 1.7 | 2 |
| 45 Invention | Compound A-1 | $0.8 \times 10^{-3}$ | 3.7 | 5 |
| 46 Invention | Compound A-6 | $0.8 \times 10^{-3}$ | 3.9 | 5 |
| 47 Invention | Compound A-8 | $0.8 \times 10^{-3}$ | 4.0 | 5 |
| 48 Invention | Compound A-10 | $0.8 \times 10^{-3}$ | 3.1 | 4 |
| 49 Invention | Compound A-11 | $0.8 \times 10^{-3}$ | 3.6 | 5 |
| 50 Invention | Compound A-15 | $0.8 \times 10^{-3}$ | 3.3 | 4 |
| 51 Invention | Compound A-20 | $0.8 \times 10^{-3}$ | 3.4 | 4 |
| 52 Comparison | Comparative Compound A | $0.4 \times 10^{-3}$ | 1.6 | 1 |
| 53 Comparison | Comparative Compound A | $0.8 \times 10^{-3}$ | 2.2 | 3 |
| 54 Comparison | Comparative Compound A | $1.5 \times 10^{-3}$ | 2.4 | 3 |

TABLE 2-continued

| | Sample | Compound | Added amount (mol/mol Ag) | Dmax | Halftone dot quality |
|---|---|---|---|---|---|
| 55 | Comparison | Comparative Compound B | $0.4 \times 10^{-3}$ | 1.5 | 1 |
| 56 | Comparison | Comparative Compound B | $0.8 \times 10^{-3}$ | 2.0 | 2 |
| 57 | Comparison | Comparative Compound B | $1.5 \times 10^{-3}$ | 2.1 | 2 |
| 58 | Comparison | Comparative Compound C | $0.4 \times 10^{-3}$ | 1.5 | 1 |
| 59 | Comparison | Comparative Compound C | $0.8 \times 10^{-3}$ | 1.7 | 2 |
| 60 | Comparison | Comparative Compound C | $1.5 \times 10^{-3}$ | 1.9 | 2 |
| 61 | Comparison | Comparative Compound D | $0.4 \times 10^{-3}$ | 1.5 | 1 |
| 62 | Comparison | Comparative Compound D | $0.8 \times 10^{-3}$ | 1.7 | 2 |
| 63 | Comparison | Comparative Compound D | $1.5 \times 10^{-3}$ | 1.8 | 2 |
| 64 | Comparison | Comparative Compound E | $0.4 \times 10^{-3}$ | 1.5 | 1 |
| 65 | Comparison | Comparative Compound E | $0.8 \times 10^{-3}$ | 2.1 | 2 |
| 66 | Comparison | Comparative Compound E | $1.5 \times 10^{-3}$ | 2.2 | 3 |
| 67 | Invention | Compound B-1 | $0.4 \times 10^{-3}$ | 3.5 | 4 |
| 68 | Invention | Compound B-1 | $0.8 \times 10^{-3}$ | 4.0 | 5 |
| 69 | Invention | Compound B-1 | $1.5 \times 10^{-3}$ | 4.2 | 5 |
| 70 | Invention | Compound B-2 | $0.4 \times 10^{-3}$ | 3.7 | 4 |
| 71 | Invention | Compound B-2 | $0.8 \times 10^{-3}$ | 4.2 | 5 |
| 72 | Invention | Compound B-2 | $1.5 \times 10^{-3}$ | 4.4 | 5 |
| 73 | Invention | Compound B-3 | $0.4 \times 10^{-3}$ | 4.1 | 5 |
| 74 | Invention | Compound B-3 | $0.8 \times 10^{-3}$ | 4.5 | 5 |
| 75 | Invention | Compound B-3 | $1.5 \times 10^{-3}$ | 4.6 | 5 |
| 76 | Invention | Compound B-6 | $0.4 \times 10^{-3}$ | 3.9 | 4 |
| 77 | Invention | Compound B-6 | $0.8 \times 10^{-3}$ | 4.3 | 5 |
| 78 | Invention | Compound B-6 | $1.5 \times 10^{-3}$ | 4.5 | 5 |
| 79 | Invention | Compound B-11 | $0.4 \times 10^{-3}$ | 3.2 | 4 |
| 80 | Invention | Compound B-11 | $0.8 \times 10^{-3}$ | 3.8 | 4 |
| 81 | Invention | Compound B-11 | $1.5 \times 10^{-3}$ | 4.2 | 5 |
| 82 | Invention | Compound B-22 | $0.4 \times 10^{-3}$ | 3.6 | 4 |
| 83 | Invention | Compound B-22 | $0.8 \times 10^{-3}$ | 4.0 | 4 |
| 84 | Invention | Compound B-22 | $1.5 \times 10^{-3}$ | 4.5 | 5 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a compound represented by the following general formula (Ia) or (Ib):

$$R^1—L^1—R^2—L^2—R^3—NHNH—G^1—R^4 \quad \text{(Ia)}$$

$$R^6—L^3—R^2—NHNH—G—R^4 \quad \text{(Ib)}$$

wherein $L^1$ represents an $—SO_2NR^5—$ group, an $—NR^5SO_2NR^5—$ group, an $—NR^5CONR^5—$ group or a $—G^2P(O)(G^2R^5)—NR^5—$ group; $L^2$ represents an $—SO_2NR^5—$ group; $L^3$ represents an $—SO_2NR^5—$ group, an $—NR^5SO_2NR^5—$ group, a $—CONR^5—$ group, an $—NR^5CONR^5—$ group or a $—G^2P(O)(G^2R^5)—NR^5—$ group; $G^1$ represents a —CO— group, an $—SO_2—$ group, an —SO— group, a —COCO— group, a thiocarbonyl group, an iminomethylene group or a $—P(O)(G^2R^5)—$ group; $G^2$ represents a single bond, an —O— group or an $—NR^5—$ group; $R^1$ represents an aliphatic or aromatic group containing four or more repeating ethylene oxide units or an aliphatic or aromatic group containing at least one quaternary ammonium cation; $R^2$ and $R^3$ each represents a divalent aliphatic or aromatic group; $R^4$ represents a hydrogen atom, an aliphatic group, an aromatic group, an alkoxy group, an aryloxy group or an amino group; $R^5$ represents a hydrogen atom, an aliphatic group or an aromatic group; and $R^6$ is a group represented by formula (IIb), (IIIb), (IVb) or (Vb):

$$R^{11}—O—(CH_2CH_2O)_m—(CH_2)_p—(S—(CH_2)_r)_n— \quad \text{(IIb)}$$

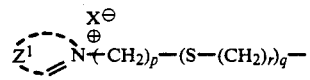
(IIIb)

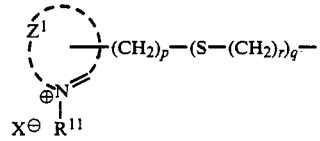
(IVb)

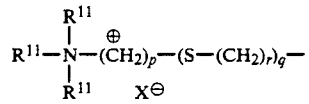
(Vb)

wherein $R^{11}$ represents an aliphatic or aromatic group; and the three $R^{11}$'s in general formula (Vb) may be the same or different and they may be connected to each other to form a ring;

$Z^1$ represents a group of atoms required to form a nitrogen-containing heterocyclic aromatic group;

the suffix m represents an integer from 4 to 20;

the suffix n represents 0 or 1 with the proviso that n=1 when $L^3$ is an $—SO_2NR^5—$ group or a $—CONR^5—$ group;

the suffixes p and r each represents an integer from 1 to 20 and in general formula (IVb), p may be 0;

the suffix q represents 0 or 1;

$X^-$ represents a paired anion or a paired anion portion that forms an intramolecular salt.

2. The silver halide photographic material of claim 1, wherein R: is selected from the groups represented by general formulas (IIa) to (Va):

$$R^{11}—O—(CH_2CH_2O)_m—(CH_2)_p—(S—(CH_2)_r)_q— \quad \text{(IIa)}$$

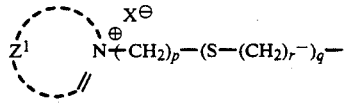
(IIIa)

-continued (IVa)

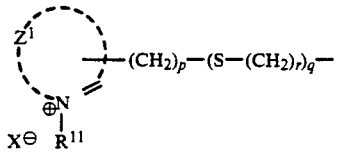

(Va)

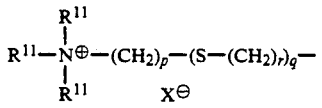

wherein $R^{11}$ represents an aliphatic or aromatic group; and the three $R^{11}$'s in general formula (Va) may be the same or different and they may be connected to each other to form a ring;

$Z^1$ represents a group of atoms required to form a nitrogen-containing heterocyclic aromatic group;

the suffix m represents an integer from 4 to 20;

the suffixes p and r each represents an integer from 1 to 20 and in general formula (IVa), p may be 0;

the suffix q represents 0 or 1;

and $X^-$ represents a paired anion or a paired anion portion that forms an intramolecular salt.

3. The silver halide photographic material of claim 1, wherein $G^1$ is a —CO— group.

4. The silver halide photographic material of claim 1, wherein $R^2$ and $R^3$ each is an aryl group.

5. The silver halide photographic material of claim 1, wherein $R^5$ is a hydrogen atom.

6. The silver halide photographic material of claim 1, wherein $R^1$, $R^2$, $R^3$ or $R^4$ includes a ballast group.

7. The silver halide photographic material of claim 1, wherein $R^1$, $R^2$, $R^3$ or $R^4$ includes a group which facilitates the adsorption of the compound of general formula (Ia) or (Ib) to the surface of the silver halide grains.

8. The silver halide photographic material of claim 1, wherein the amount of the compound of general formula (Ia) or (Ib) incorporated in the material is from $1\times10^{-6}$ to $5\times10^{-2}$ mol per mol of silver halide.

9. The silver halide photographic material of claim 1, wherein the compound of general formula (Ia) or (Ib) is incorporated in a silver halide emulsion layer.

10. The silver halide photographic material of claim 1, further comprising a development accelerator.

11. The silver halide photographic material of claim 10, wherein the amount of the development accelerator is from $1\times10^{-3}$ to 0.5 grams square meter of photographic material.

12. The silver halide photographic material of claim 1, wherein said compound is represented by formula (Ia).

13. The silver halide photographic material of claim 1, wherein said compound is represented by formula (Ib).

* * * * *